United States Patent [19]

Caron

[11] Patent Number: 4,624,373

[45] Date of Patent: Nov. 25, 1986

[54] STORING RACK FOR CORE SAMPLE BOXES

[76] Inventor: John D. Caron, 9 Birch Bay, Winnipeg, Manitoba, Canada, R2J 2B7

[21] Appl. No.: 608,947

[22] Filed: May 10, 1984

[30] Foreign Application Priority Data

May 19, 1983 [CA] Canada ..... 428483

[51] Int. Cl.[4] ..... A47G 19/08

[52] U.S. Cl. ..... 211/41; 211/74

[58] Field of Search ..... 211/41, 71, 74, 70.4, 211/60.1, 59.4; 361/415; 20/428; 34/239, 240

[56] References Cited

U.S. PATENT DOCUMENTS

| | | | |
|---|---|---|---|
| 297,485 | 4/1884 | Aycock | 211/60.1 X |
| 441,278 | 11/1890 | Brumbaugh | 211/41 |
| 1,194,670 | 8/1916 | Schmidt | 211/41 |

FOREIGN PATENT DOCUMENTS

| | | | |
|---|---|---|---|
| 6931120 | 8/1965 | Italy | 211/74 |
| 30319 | 2/1904 | Switzerland | 211/74 |

*Primary Examiner*—J. Franklin Foss
*Assistant Examiner*—Sarah A. Lechok Eley
*Attorney, Agent, or Firm*—Stanley G. Ade

[57] ABSTRACT

A rack for storing elongate core sample boxes is formed from three separate frames each having three uprights formed of timber, cross members of timber and a plurality of aluminum tubes extending across between the uprights and passing through bores in the uprights. Each junction between a tube and an upright is locked in position by a nail passing transversely to the tube through the upright. The frames can be transported in assembled form and then the rack completed by the application of end and top panels.

14 Claims, 2 Drawing Figures

STORING RACK FOR CORE SAMPLE BOXES

BACKGROUND OF THE INVENTION

This invention relates to the storing of core sample boxes. In geological exploration, large numbers of core samples are drilled from the earth to provide information concerning the earth's structure in the geological area concerned. Such a core sample may be of the order of 3000 feet in length and as it is withdrawn from the earth, it is collected in boxes of 5 feet in length so as to provide a permanent record of the earth's structure at that location.

In order to avoid transport of large number of core boxes, often in areas where there is no organized transportation, the boxes need to be stored on site for future record. It will be appreciated that after incurring the considerable expense of a core sample bore, it is highly desirable to ensure that the core sample is maintained for future study when future exploration is being carried out possibly for different reasons. The core samples are collected in 5 feet lengths in elongated boxes each containing three such samples.

Racks for such boxes has traditionally been manufactured on site and is prone to twisting or warping thus, effecting locking the boxes in position in the racks which of course renders the whole storage system totally useless since it prevents recovery of the boxes for future study without considerable effort to remove the warping. Furthermore, the manufacture of the racks on site has been a long and time consuming business with difficulty in assembling the racks initially in untwisted form and often in harsh climatic conditions.

It is one object of the present invention to provide a rack which can be quickly or easily assembled on site and which avoids the problem of twisting of the rack thus allowing the core samples to be recovered readily at any time, for future study.

The invention, therefore, provides according to a first aspect a rack for storing elongated core sample boxes comprising a plurality of support frames each frame being formed as a separate transportable unit from a plurality of spaced parallel timber uprights interconnected by a pair of cross members each extending the full length of the frame and connected to each upright at the upper and lower end respectively thereof and a plurality of rack support members each formed from tubular metal and extending the full length of the frame and each cooperating with a respective bore in each of the uprights such that the support members extend in parallel spaced relation, and a plurality of planar support members for forming end and top panels for interconnecting the frames in spaced parallel relation whereby the core sample boxes can rest across the rack support members.

According to a second aspect of the invention, there is provided a method of storing elongate core sample boxes comprising transporting and supplying in assembled form a plurality of support frames, each frame being formed as a separate transportable unit from a plurality of spaced parallel timber uprights interconnected by a pair of cross members each extending the full length of the frame and connected to each upright at the upper and lower end respectively thereof and a plurality of rack support members each formed from tubular metal and extending the full length of the frame and cooperating with a respective bore in each of the uprights such that the support members extend in parallel spaced relation, erecting the frames in spaced parallel relationship on site and interconnecting the frames by a plurality of planar support members forming end and top panels for the frames whereby the core sample boxes can rest across the rack support members.

It is one advantage of this invention that the rack is formed in relatively short discrete lengths of the order of 10 feet (3.05 meters) in length which sections are resistant to twisting or warping and are relatively rigid thus providing a long term support for the boxes in which the boxes are maintained parallel and hence can be readily removed at a later time.

It is a further advantage of the invention that the frames are manufactured off site and supplied in assembled form and hence the rack can be assembled on site very quickly. Furthermore, the rack is supplied in flat form so that the transportation costs are not excessive, and can easily be transported to remote sites by small aircraft.

It is a yet further advantage of the invention that the rack as formed and including sample boxes can be transported in one piece if it is desired to transport a particular set of core sample boxes from the sampling site.

With the foregoing in view and other advantages as will become apparent to those skilled in the art to which this invention relates as this specification proceeds, the invention is herein described by reference to the accompanying drawings forming a part hereof, which includes a description of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 1:
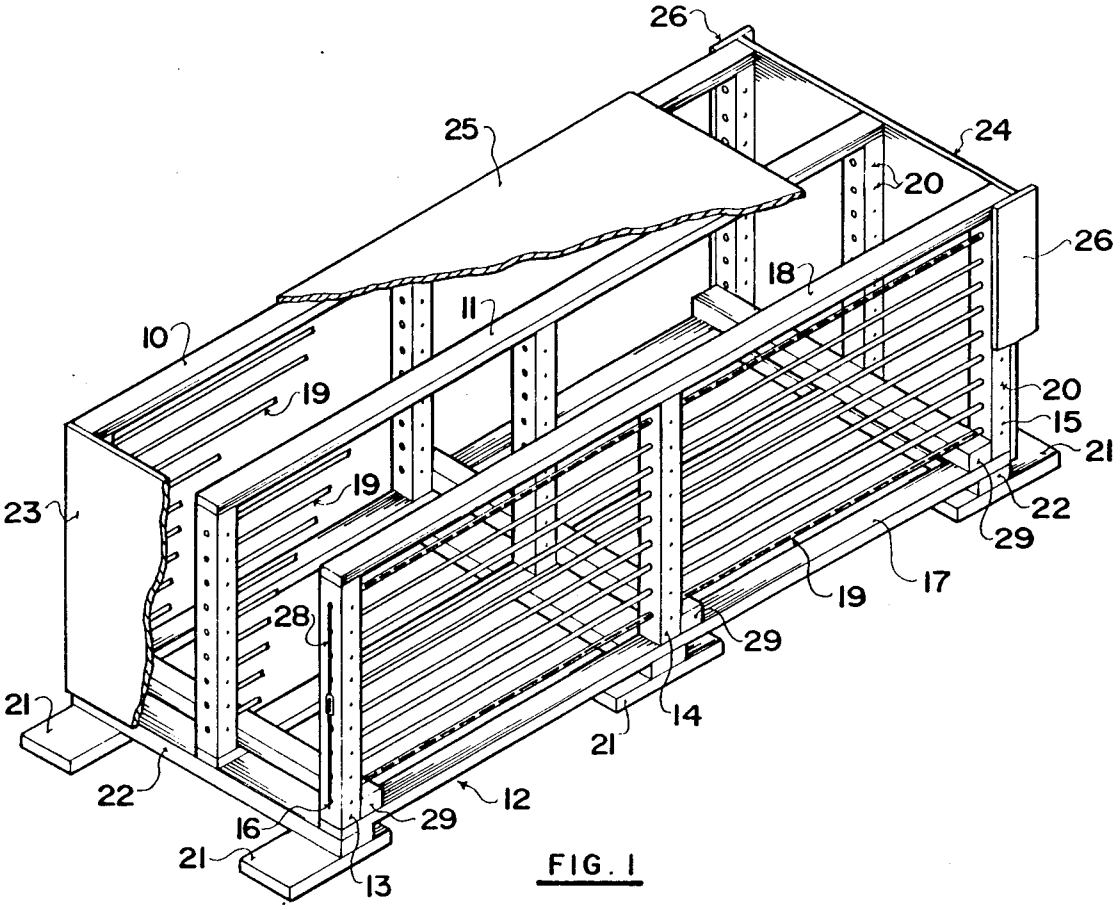
FIG. 1 is an isometric view of the rack according to the invention with part of the panels broken away to show the interior structure of the rack.
Figure 2:
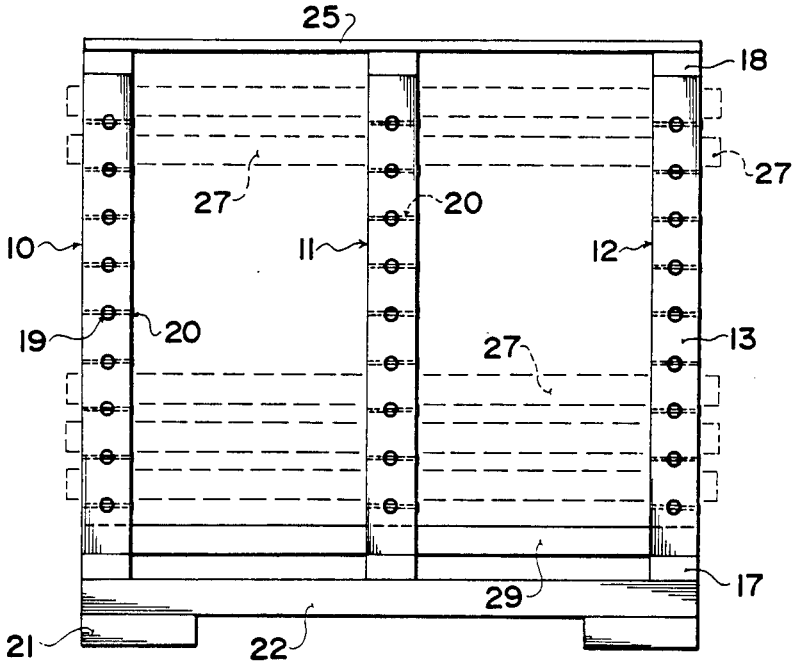
FIG. 2 is a cross sectional view looking along the rack and taken through three uprights.

The rack comprises three parallel spaced frames 10, 11 and 12 which equidistantly spaced to provide front and rear frames 12, 10 and a central frame 11. Each frame is manufactured separately and forms a separate unit which is sufficiently rigid for separate manoeuver and transportation while retaining its rectangular structure.

Specifically, the frame 12 comprises three uprights 13, 14 and 15 each of 4 inch by 4 inch (10.16 cm by 10.16 cm) timber and each having a plurality of bores 16 therethrough arranged along a central plane thereof. Thus each of the uprights is identical and can be identically manufactured in an assembly line type process. The frame 12 also incorporates a pair of cross members 17, 18 attached to the ends of the uprights suitably by vertical nails with the cross members 17, 18 extending the full distance from the outer uprights thus forming a rectangular frame. The cross members 17, 18 are formed from, for example, 2 inch by 4 inch timber (5.08 cm by 10.16 cm) in assembly the bore 16 of the uprights are arranged co-planar so as to be able to receive tubular rack support members 19 each extending through respective bores in the uprights 13, 14, 15. The bores 16 are of $\frac{3}{4}$ inch diameter (1.9 cm) so as to receive the aluminum tubes 19 of the same diameter. The length of the tubes 19 is substantially the same as the cross members 17, 18 so that they extend from the upright 13 to the upright 15. At each junction between an upright and a tube, a nail 20 is inserted transversely to the bore 16 so as to pass through the bore and through the tube thus locking the tube to the respective upright.

The rigidity of each frame can be assisted by a cable 28 which extends in a loop along the top tube, down the end upright and back along the bottom tube. The cable ends are clamped together to draw the frame inwardly in clamped condition.

The rack is completed on site by erecting the frames 10, 11, 12 in spaced parallel relationship on suitable timber supports provided by foot pads 21 and cross pads 22 with the cross pads lying directly beneath the parallel uprights and the foot pads lying at right angles to the cross pads 22 and extending partly along each frame. The level of the pads can be adjusted on site by suitable packing or removal of earth to ensure level ground for receiving the frames. Additional cross members 29 are nailed across the inside bottom end of each upright to assist in maintaining the spacing of the frame.

The rack is then completed by the application of end panels 23, 24 which are dimensioned such that the uprights of the outer frames 10, 12 lie along the edges of the end panels. The height of the end panels is selected to match the height of the uprights so that effectively a box structure is formed by the frames and the end panels. A top panel 25 of the same width as the end panels such that the cross members 18 line along the edges of the top panel is then positioned in engagement with the cross members 18 to form a top for the box structure.

The length of the top panel 25 is less than the length of the rack defined by the length of the frames so that if a next adjacent rack exactly similar to that shown in FIG. 1 is abutted to one end of the first, a next top panel 25 can be applied across both the racks to tie them together. This tieing of the two abutting racks together can be assisted by a scabbing piece 26 interconnecting the two adjacent uprights of the two abutting racks both at the front and the rear, and by passing the cable 28 through abutting tubes of both racks with downward lengths only at the outermost uprights.

The length of the frames is chosen such that they can be readily transported and the optimum length is currently believed to be 10 feet. The rack assembly can be manufactured at a remote location from the intended use in that the individual frames formed each provide a rigid rectangular structure with the end and top panels also cut to size but transported in flat pack form for the simple assembly of the whole structure as shown in FIG. 1 on site.

The elongate core sample boxes are shown in phantom at 27 resting across the tubular rack support members 19.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A rack for storing elongate core sample boxes comprising a plurality of rectangular support frames, each frame being formed as a separate transportable unit and including a plurality of spaced parallel timber uprights, a pair of cross members each extending along a full length of the frame such that one of the pair is connected to each upright at an upper end thereof and the other of the pair is connected to each upright at a lower end thereof, each of the uprights having therethrough a plurality of bores spaced along the length of the upright, each bore extending through the upright parallel to the cross members, and a plurality of rack support members each formed from tubular metal and extending the full length of the frame parallel to the cross members and to each other and each extending into a respective bore in each of the uprights, means for coupling each support member to an upright at a portion of the support member extending into the bore of the upright such that the support members are supported by the uprights in parallel spaced relation, and a plurality of planar support members for forming end and top panels for interconnecting the frames in spaced parallel relation whereby the core sample boxes can rest across the rack support members.

2. A rack according to claim 1 wherein each frame is no longer than 10 feet in length.

3. A rack according to claim 1 wherein each frame is of the order of 10 feet (3.05 meters) in length.

4. A rack according to claim 1 wherein the tubular metal is formed of aluminum tubes.

5. A rack according to claim 4 wherein the aluminum tubes are of $\frac{3}{4}$ inch (1.9 cm) diameter.

6. A rack for storing elongate core sample boxes comprising a plurality of rectangular support frames, each frame being formed as a separate transportable unit and including a plurality of spaced parallel timber uprights, a pair of cross members each extending along a full length of the frame such that one of the pair is connected to each upright at an upper end thereof and the other of the pair is connected to each upright at a lower end thereof, each of the uprights having therethrough a plurality of bores spaced along the length of the upright, each bore extending through the upright parallel to the cross members, and a plurality of rack support members each formed from tubular metal and extending the full length of the frame parallel to the cross members and to each other and each extending into a respective bore in each of the uprights, means for coupling each support member to an upright at a portion of the support member extending into the bore of the upright such that the support members are supported by the uprights in parallel spaced relation, and a plurality of planar support members for forming end and top panels for interconnecting the frames in spaced parallel relation whereby the core sample boxes can rest across the rack support members, wherein said coupling means comprises a nail inserted into the upright transversely to the support member so as to engage the support member.

7. A rack according to claim 1 wherein each frame includes three uprights.

8. A rack according to claim 1 wherein the cross members are formed of timber.

9. A rack according to claim 7 wherein the uprights are of 4 inch (10.16 cm) by 4 inch timber and wherein the cross members are of 2 inch (5.08 cm) by 4 inch timber.

10. A rack according to claim 1 wherein the panels are of plywood.

11. A rack according to claim 1 including three frames so as to support each box on three spaced parallel support members.

12. A rack according to claim 1 wherein the end panels and the top panel are of the same width such that with the outside frames positioned adjacent the edges of the top and side panels the width of the rack is defined.

13. A rack according to claim 1 wherein the top panel is of shorter length than the frames whereby a second top panel can extend from the rack to a next adjacent abutting rack whereby to interconnect the adjacent racks.

14. A rack for storing elongate core sample boxes comprising a plurality of rectangular support frames, each frame being formed as a separate transportable unit and including a plurality of spaced parallel timber uprights, a pair of cross members each extending along a full length of the frame such that one of the pair is connected to each upright at an upper end thereof and the other of the pair is connected to each upright at a lower end thereof, each of the uprights having therethrough a plurality of bores spaced along the length of the upright, each bore extending through the upright parallel to the cross members, and a plurality of rack support members each formed from tubular metal and extending the full length of the frame parallel to the cross members and to each other and each extending into a respective bore in each of the uprights, means for coupling each support member to an upright at a portion of the support member extending into the bore of the upright such that the support members are supported by the uprights in parallel spaced relation, and a plurality of planar support members for forming end and top panels for interconnecting the frames in spaced parallel relation whereby the core sample boxes can rest across the rack support members, and including a cable extending through one of the tubular support members, down an end upright and back through another tubular support member to clamp the frame in rigid condition.

* * * * *